US010337145B2

(12) United States Patent
Gingras

(10) Patent No.: US 10,337,145 B2
(45) **Date of Patent: *Jul. 2, 2019**

(54) STATOR REFINER PLATE ELEMENT HAVING CURVED BARS AND SERRATED LEADING EDGES

(71) Applicant: Andritz Inc., Glens Falls, NY (US)

(72) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 300 days.

This patent is subject to a terminal disclaimer.

(21) Appl. No.: 15/430,774

(22) Filed: Feb. 13, 2017

(65) Prior Publication Data

US 2017/0152629 A1 Jun. 1, 2017

Related U.S. Application Data

(63) Continuation of application No. 14/056,348, filed on Oct. 17, 2013, now Pat. No. 9,604,221.

(60) Provisional application No. 61/724,516, filed on Nov. 9, 2012.

(51) Int. Cl.
*D21D 1/30* (2006.01)
*B02C 7/12* (2006.01)

(52) U.S. Cl.
CPC ..... *D21D 1/303* (2013.01); *B02C 7/12* (2013.01); *D21D 1/306* (2013.01)

(58) Field of Classification Search
CPC ..... B02C 7/12; D21D 1/303; D21D 1/306
USPC ..... 241/261.2, 261.3, 298, 260
See application file for complete search history.

(56) References Cited

U.S. PATENT DOCUMENTS

| | | | |
|---|---|---|---|
| 7,900,862 | B2 | 3/2011 | Gingras |
| 8,157,195 | B2 | 4/2012 | Gingras |
| 2013/0015281 | A1 | 1/2013 | Gingras |

FOREIGN PATENT DOCUMENTS

| | | |
|---|---|---|
| EP | 2559807 | 2/2013 |
| WO | 0056459 | 9/2000 |

OTHER PUBLICATIONS

European Search Report, dated Mar. 30, 2017, pp. 1-10, European Patent Office, Munich, Germany.

*Primary Examiner* — Faye Francis
(74) *Attorney, Agent, or Firm* — Robert Joseph Hornung

(57) ABSTRACT

A refining system and process using a specially designed stator refiner plate. The specially designed stator refiner plate includes a major refining surface having a series of bars and grooves, the bars include a leading surface having an irregular surface. The irregular surface hosts a series of protrusions extending along the bar. The bar further comprises a trailing surface that is relatively smooth compared to the leading surface. The trailing surface lacks an irregular surface.

18 Claims, 5 Drawing Sheets

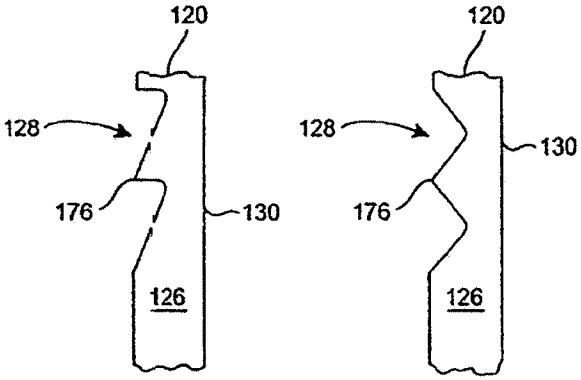
Fig. 3
Fig. 4
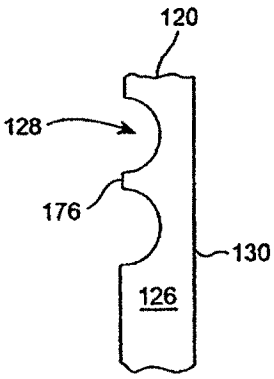
Fig.5
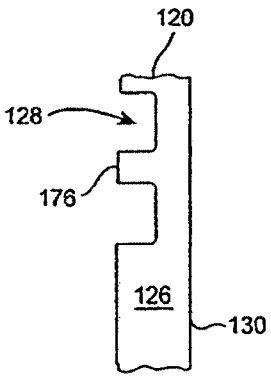
Fig. 6
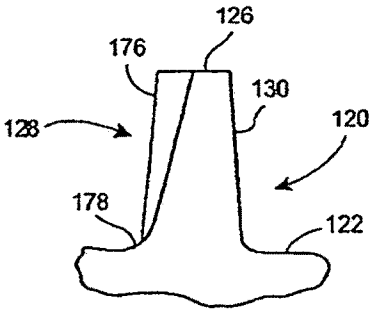
Fig. 7
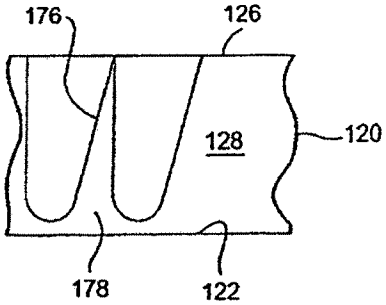
Fig. 8

STATOR REFINER PLATE ELEMENT HAVING CURVED BARS AND SERRATED LEADING EDGES

RELATED APPLICATION

This application claims priority to U.S. patent application Ser. No. 14/056,348 filed on Oct. 17, 2013, Now U.S. Pat. No. 9,604,221 which in turn claims the benefit of U.S. provisional patent application 61/724,516, filed on Nov. 9, 2012, the entirety of which is incorporated herein by reference.

BACKGROUND

This invention relates to disc refiners for lignocellulosic materials, such as disc refiners used for producing mechanical pulp, thermomechanical pulp, manufacture of medium density fiberboard (MDF), pulp used particle board, chemical pulp, stock preparation, and a variety of chemithermomechanical pulps (collectively referred to as mechanical pulps and mechanical pulping processes) as well as high, medium and low consistency refining.

In refiners used in the mechanical pulping processes, raw material, typically wood or other lignocellulosic material (collectively referred to as wood chips), is fed through the middle of one of a refiners discs and propelled outwards by a strong centrifugal force created by the rotation of one or both rotor discs. These refiners can be high, medium or low consistency refiners. Refiner plates are mounted on each of the opposing faces of the refiner discs. The wood chips move between the opposing refiner plates in a generally radial direction from the inner perimeter to the outer perimeter of the plates and disc.

The refiner discs may operate at rotational speeds of 900 to 2300 revolutions per minute (RPM) when used for high consistency refining and as low as 400 revolutions per minute for low consistency refining. While the wood chips are between the discs, energy is transferred to the material via refiner plates attached to the discs.

The refiner plates generally feature a pattern of bars and grooves, as well as dams, which together provide a repeated compression and shear actions on the lingo-cellulosic fiber material. The compression and shear actions acting on the material separates lignocellulosic fibers from the raw material, provides a certain amount of development or fibrillation of the material, and generates some fiber cutting which is usually less desirable. The fiber separation and development is necessary for transforming the raw wood chips into a suitable board or paper making fiber component.

In the mechanical pulping process, a large amount of friction occurs, such as between the wood chips and the refiner plates. This friction reduces the energy efficiency of the process.

Efforts to develop refiner plates which work at higher energy efficiency, e.g., lower friction, have been achieved and typically involve reducing the operating gap between the discs. Known techniques for improving energy efficiencies typically involve design features on the front face of refiner plate segments that usually speed up the feed of wood chips across the refining zone(s) on the refiner plates. These techniques may result in reducing the thickness of the fibrous pad formed by the wood chips flowing between the refiner plates. When energy is applied by the refiner plates to a thinner fiber pad, the compression rate applied to the wood chips may become greater for a given energy input, and may result in a more efficient energy usage in refining the wood chips.

Reducing the thickness of the fiber pad allows for smaller operating gaps, e.g., the clearance between the opposing refiner plates. Reducing the gap may result in an increase in cutting of the fibers of the wood chips, a reduction of the strength properties of the pulp produced by the discs, an increased wear rate of the refiner plates, and a reduction in the operating life of the refiner plates.

The energy efficiency is believed to be greatest towards the periphery of the refiner discs. The relative velocities of refiner plates are greatest in the peripheral region of the plates. The refining bars on the refiner plates cross each other on opposing plates at a higher velocity in the peripheral regions of the refiner plates. The higher crossing velocity of the refining bars is believed to increase the refining efficiency in the peripheral region of the plates.

The wood fibers tend to flow quickly through the peripheral region of the refiner plates. The increase in flow of the fibers in the peripheral region is due to the strong centrifugal forces and forces created by the forward flow of steam generated between the discs. The shortness of the retention period in the peripheral region limits the amount of work that can be done in that most efficient part of the refining surface.

Development of serrated or jagged refiner plate geometry as described in U.S. Pat. No. 8,157,195 is believed to provide energy-efficient refining. The concept uses a variety of opposing plates, depending on the process and the pulp properties desired.

Known refiner plates and configurations include those described in U.S. Pat. Nos. 8,157,195 & 7,900,862 as well as U.S. application Ser. No. 13/547,144, the entirety of each of which are expressly incorporated by reference herein.

BRIEF DESCRIPTION

In an aspect, there is a refiner plate for a mechanical refiner of lignocellulosic material. The refiner plate includes a stator refining surface affixed to a substantially immovable substrate. The stator refining surface comprises multiple bars and grooves situated on the stator refining surface, and the bars each comprises a leading sidewall and a trailing sidewall that is opposite of the leading sidewall. The leading sidewall has an irregular surface that includes multiple protrusions extending out of the irregular surface towards a trailing sidewall on an adjacent bar. The trailing sidewall has a smooth surface and lacks the irregular surface on the leading sidewalls.

In another aspect, there is a method of mechanically refining lignocellulosic material in a refiner having opposing refiner plates comprising a rotor refiner plate and a stator refiner plate.

The method includes the steps of: introducing lignocellulosic material to an inlet in one of two opposing refiner plates, the opposing refiner plates include a rotor refiner plate and a stator refiner plate; rotating the rotor refiner plate and maintaining the stator refiner plate substantially stationary such that the material moves radially outwardly through a gap between the plates due to centrifugal forces created by the rotation; as the material moves through the gap, passing the material over bars in a refining section of the stator refiner plate and through grooves between the bars, the bars comprise a leading sidewall and a trailing sidewall opposite of the leading sidewall; inhibiting the movement of the fibrous material through the grooves by interaction of the fibrous material and an irregular surface on the leading sidewall of the bar adjacent the groove, but the trailing surface opposite of the leading sidewall does not have an irregular surface; and discharging the material from the gap at an outer periphery of the refiner plates.

BRIEF DESCRIPTION OF THE DRAWINGS

FIG. 3 schematically illustrates a profile of the irregular surface in a "7" shape on a leading sidewall of a bar in the outer refining zone of a refiner plate segment in accordance with an embodiment;

FIG. 4 schematically illustrates a profile of the irregular surface in a "saw tooth" shape on a leading sidewall of a bar in the outer refining zone of a refiner plate segment in accordance with an embodiment;

FIG. 5 schematically illustrates a profile of the irregular surface in a concave shape on a leading sidewall of a bar in the outer refining zone of a refiner plate segment in accordance with an embodiment;

FIG. 6 schematically illustrates a profile of the irregular surface in a "teeth" shape on a leading sidewall of a bar in the outer refining zone of a refiner plate segment in accordance with an embodiment;

FIG. 7 schematically illustrates a cross-section of the irregular surface in a "7" shape on a leading sidewall of a bar in the outer refining zone of a refiner plate segment in accordance with an embodiment;

FIG. 8 schematically illustrates a front view of the irregular surface in a "7" shape on a leading sidewall of a bar in the outer refining zone of a refiner plate segment in accordance with an embodiment;

DETAILED DESCRIPTION

Figure 1:
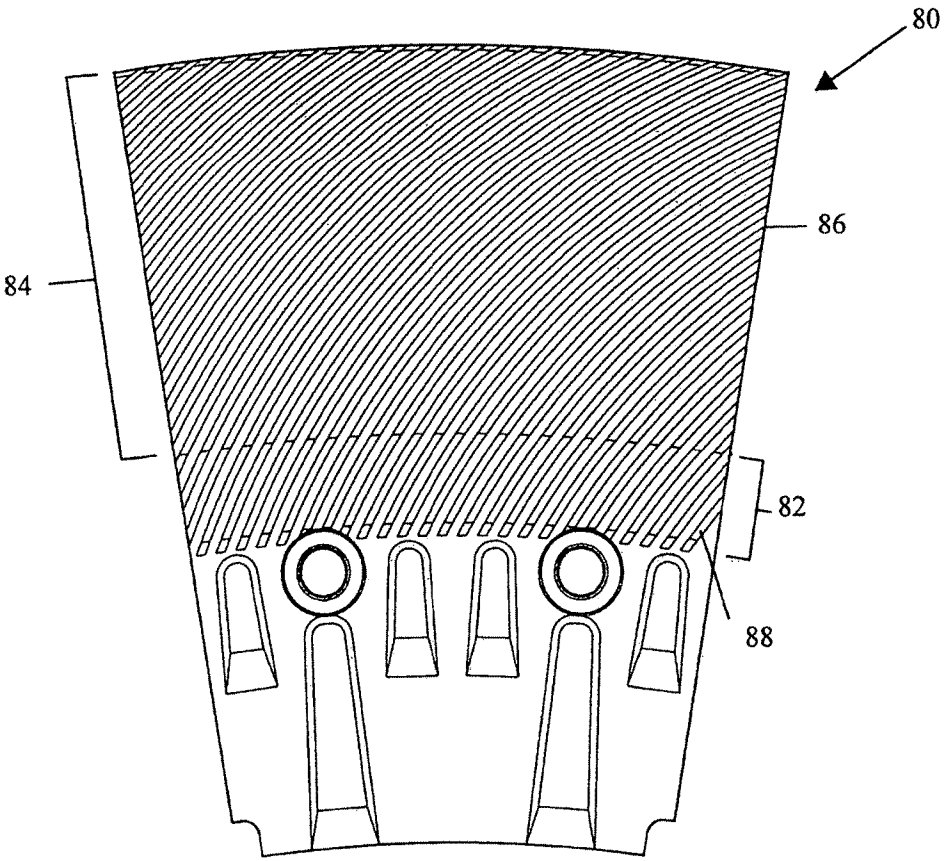
Fig.1 (Prior art)
FIG. 1 is a prior art stator plate segment.

In a refiner, two opposing refining surfaces (plates) may be positioned such that at least one refiner plate rotates relative to the other refiner plate. In this respect, there may be one refiner plate that is held substantially stationary; this is generally called a "stator." The other refiner plate that rotates is generally called a "rotor."

It is believed that when using feeding stator elements to face a rotor element featuring a strong holding angle and serrated edges, the wear may be uneven, may lead to fast wear of the feeding stator element, and may limit the useful lifetime of the refiner plate combination.

Combining the serrated edges of the rotor of U.S. Pat. No. 8,157,195 with a stator element using similar features may provide energy savings that attributes to the plate combination, and may significantly improve the useful lifetime of the refiner plates.

This disclosure thus proposes special stator refiner plate geometry to provide low energy consumption in the refining process, while significantly reducing the uneven wear between rotor and stator plates, thus increasing the useful lifetime of the refiner plates.

The refining process applies a cyclical compression to a fibrous pad formed of wood chips moving in the operating gap between discs of a mechanical refiner. The energy efficiency of the refining process may be improved by increasing the compression rate of the fibrous pad, and reducing the percentage of the refining energy applied at lower compression rates, such as at the radially inward portions of the refining zone. The increased compression rate may be achieved with the plate designs disclosed herein without necessarily reducing the operating gap to the same extent done with conventional higher energy efficiency refiner plates.

A relatively wide operating gap between the rotor and stator plates in a refiner (as compared to the narrow gap in high energy efficiency refiners) may be the result of a thicker pulp pad formed between the plates. A high compression ratio may be achieved with a thick pulp pad using a significantly coarser refiner plate, as compared to conventional plates used in similar high energy efficiency applications.

A coarse refiner plate has relatively few bars as compared to a fine refiner plate typically used in refiners. The fewer number of bars in a coarse refiner plate may reduce the compression cycles applied as the bars on the rotor pass across the bars on the stator. The energy being transferred into fewer compression cycles may increase the intensity of each compression and shear event, and may increase energy efficiency.

As described in U.S. Pat. No. 8,157,195, the rotor element is believed to create a very strong holding effect on the feed material. The tops of the bars and its leading edges are covered with a generous amount of fibrous pad. On the other hand, stator elements are usually arranged using strong feeding bars with a smooth leading edge, which may allow the fiber pad to easily slip along and across its surface. This may result in faster wear on the stator plate compared to the rotor plate which is believed to be protected by a substantial layer of fiber.

In one embodiment, the refiner plate is an assembly of stator plate segments having an outer refining zone with bars that have at least a radially outer section with a curved longitudinal shape and leading sidewalls with wall surfaces that are jagged, serrated or otherwise irregular. The curved bars and resulting curved grooves between the bars feed the wood chip feed material toward the outer zone.

In another embodiment, a refining plate is conceived with a refining surface facing a second refining plate. The refining surface includes a plurality of bars upstanding from the surface. The bars extend outwardly towards an outer peripheral edge of the plate, and have a jagged or irregular surface on at least the leading sidewall of the bars. The bars are also curved, e.g., with an exponential or in an involute arc.

In a preferred embodiment, the refiner plate is a stator, which is held substantially constant without rotation during operation.

An exemplary refining plate segment conceived for a mechanical refiner of lignocellulosic material may comprise a refining surface on a substrate. The refining surface may be adapted to face a refining surface of an opposing refiner plate, and the refining surface includes bars and grooves that are situated between the bars.

An angle of each bar with respect to a radial line corresponding to the bar may increase at least 10 to 15 degrees along a radially outward direction. The angle of each bar is a feeding angle, and may be in any of a range of 5 to 70 degrees, 10 to 65 degrees, and 15 to 60 degrees at the periphery of the refining surface (and any and all feeding angles greater than 5 degrees and up to 70 degrees). The bars each include a leading sidewall with an irregular surface, wherein the irregular surface includes protrusions extending outwardly from the sidewall towards a sidewall on an adjacent bar, and the irregular surface extends from either at or near the outer periphery of the refining surface towards a radially inward direction along the bars without reaching an inlet of the refining surface.

The bars may each have a curved longitudinal shape with respect to a radial of the plate, the longitudinal shape extending through the length of the bar. The angles may increase continuously and gradually along the radially outward direction on a bar, or may increase in steps along the radially outward direction. At the radially inward inlet of the refining surface, the bars may be each arranged at an angle within 10, 15 or 20 degrees of a radial line corresponding to the bar. Further, the refining plate segment may be adapted to act as a stationary refining disc, and to face a rotating refining disc when mounted in a refiner.

The refining surface may include multiple refining zones, e.g., a first refining zone and a second refining zone. A first refining zone may have relatively wide bars and wide grooves, and a second refining zone may have relatively narrow bars and narrow grooves in comparison. The second refining zone may be situated in a radially outer section on the plate segment from the first refining zone, and the feeding angle for the second refining zone may be in any of a range of 5 to 70 degrees, 10 to 65 degrees, and 15 to 60 degrees.

The irregular surface on the leading sidewall of the bars may include a series of ramps each having a lower edge at the substrate of each groove, extending at least partially up the leading sidewall.

In an aspect, the present disclosure relates to adding serrated leading edges on the stator element which features a feeding angle. The stator element has an average feeding angle of at least 5 degrees compared to a radial line crossing the refiner plate segment. The feeding angle may be at least 10 or 15 degrees, and the feeding angle may increase from the inner radius of the refining zone to the outer radius (discharge) of the refining zone. Feeding angles greater than 0 degrees and up to and including 70 degrees may be suitable in some embodiments.

Along the leading edges of the stator bars, on at least 25% of its surface, and as much as 95% of its surface, the bars feature some form of serrated edge design to help prevent the fiber from slipping easily along and across the said stator bars. The serrated edges can be a zig-zag, a combination of recesses or protrusions having the shape of 7s, Zs, Vs, Cs, or even rectangular cuts or sections. The recesses can extend from the top surface (top of bars) all the way to the bottom surface (bottom of grooves), part of the way, or can also increase or reduce in profile depth as it goes to the bottom surface. The plate segments may also feature ramps or dams that may or may not extend part way or all the way across the groove width.

The distance between each protrusion or each recess can vary from 3 mm to 18 mm, preferably 4 mm to 12 mm.

In an aspect, the present disclosure may relate to a stator refiner plate design, featuring a feeding angle that is creating a forward pumping effect (towards the periphery of the refiner plate segment). The stator refiner plate may also feature a serrated leading edge on at least part of the refining surface so that the fiber does not easily slip alongside and across the said refiner plate bar's leading edge, therefore reducing wear.

FIG. 1 is a front view of a prior art rotor plate segment 80 having an inner refining zone 82 and an outer refining zone 84. The outer bars 86 in the outer refining zone 84 are each arranged parallel a respective radial line or are arranged at a small feeding angle, such as within 10 or 5 degrees of a radial line. The outer bars 86 are curved such that at their outer radial end they form a feeding angle of 10 to 70 degrees.

The inner bars 88 of the inner refining zone 82 have an inlet angle of zero to as high as 50 degrees. The inner bars 88 may be straight or curved to gradually form a slight feeding angle, e.g., 5 to 15 degrees feeding angle at the transition between the inner and outer refining zones. As illustrated, the prior art stator has smooth bars, such as described in U.S. Pat. No. 8,157,195.

Figure 2:
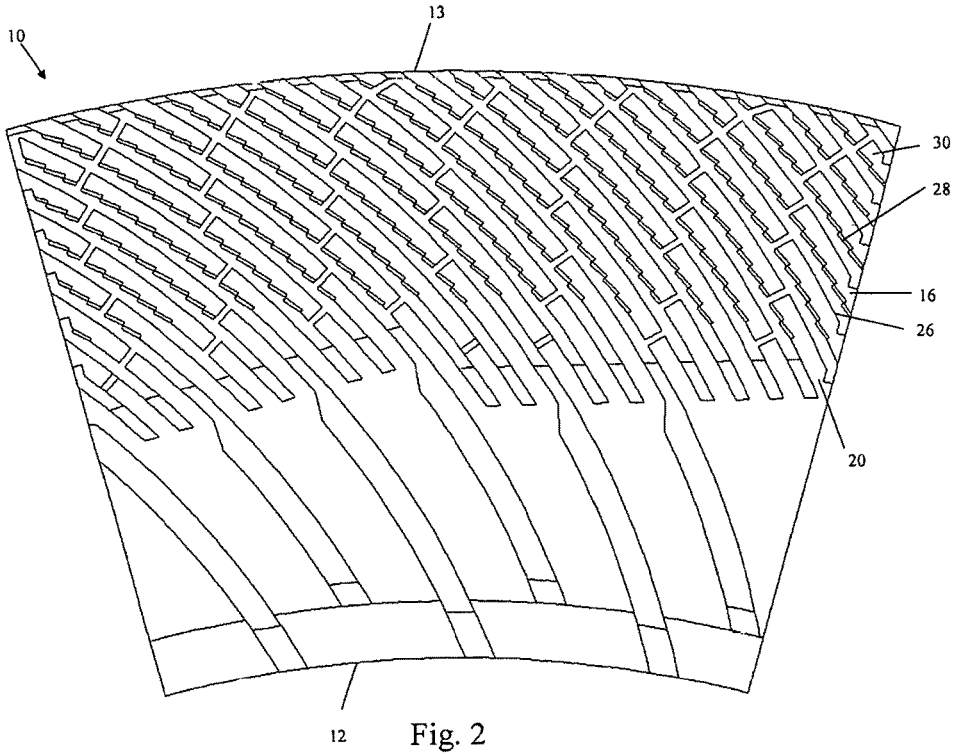
FIG. 2 schematically illustrates a stator plate segment in accordance with an embodiment.

FIG. 2 illustrates an embodiment of a stator plate segment 10. The plate segment has an inner periphery 12 and an outer periphery 13. On a major surface of the stator plate segment 10, there are a series of bars 20 and grooves 16. The grooves 16 are situated between the bars, and defined by the trailing sidewall 30 and the leading sidewall 28. The leading sidewall 28 may be a tapered edge from a ridge 26 of the bars so the jagged feature is most prominent at the upper corner edge of the bar where most of the refining is accomplished, and less prominent along the depth of the bar, particularly deep in the groove.

The irregular surface feature of the leading sidewalls 28 may be confined to the outer radial portions of the bar, but may extend through the entire length of the outermost refining zone or the entire refining zone on a major surface of the refining plate segment 10.

FIGS. 3-6 schematically each illustrate a top down view of an exemplary ridge 126, particularly the profile of the irregular surface on a leading sidewall of a bar in the outer refining zone of a refiner plate segment. The upper ridge 126 of each bar 120 includes a profile of the upper corner of the leading sidewall 128 and the trailing sidewall 130. The leading sidewall 128 has an irregular surface, e.g., a serrated feature that may be most pronounced at the upper corner of the leading sidewall 128. The irregular surface includes a series of protrusions 176 that defines each of the serrated features on the leading sidewall 128.

The irregular surface features may have a variety of shapes, including the series of "7"s shown in FIG. 3, the saw tooth feature shown in FIG. 4, the series of concave grooves in the leading sidewall shown in FIG. 5, and a series of teeth, e.g., rectangular teeth, shown in FIG. 6. The shape of the irregular features is a matter of design preference. The shape to be used may depend on the feed material, and plate segment composition, manufacturing and molding considerations.

FIG. 7 shows in cross section a bar 120 having a smooth trailing sidewall 130 and an irregular surface, e.g., series of "7"s, on the leading sidewall 128. FIG. 8 shows a front view of the same irregular surface feature on the bar leading sidewall as shown in FIG. 7, from the angle of the protrusion 176. The irregular surface feature may be more pronounced on the bar sidewall near the bar ridge 126 where most refining occurs. The irregular surface feature and protrusions 176 may become progressively less pronounced on the leading sidewall 128 in the direction of the plate substrate 122. The protrusions 176 of the irregular surface tend to retard the movement of feed material through the grooves, and thereby increase the retention time of feed material in the refining zone(s) of the plates. The protrusions 176 may be tapered from ridge 126 to substrate 122. Near substrate 122 of the plate, the protrusions 176 may blend into a smooth lower surface 178 of the leading sidewall 128. Both FIG. 7 and FIG. 8 show a tapering off of the irregular surface feature from the ridge 126 and tip of protrusions 176 to the substrate 122, forming the smooth lower surface 178.

Figure 9:
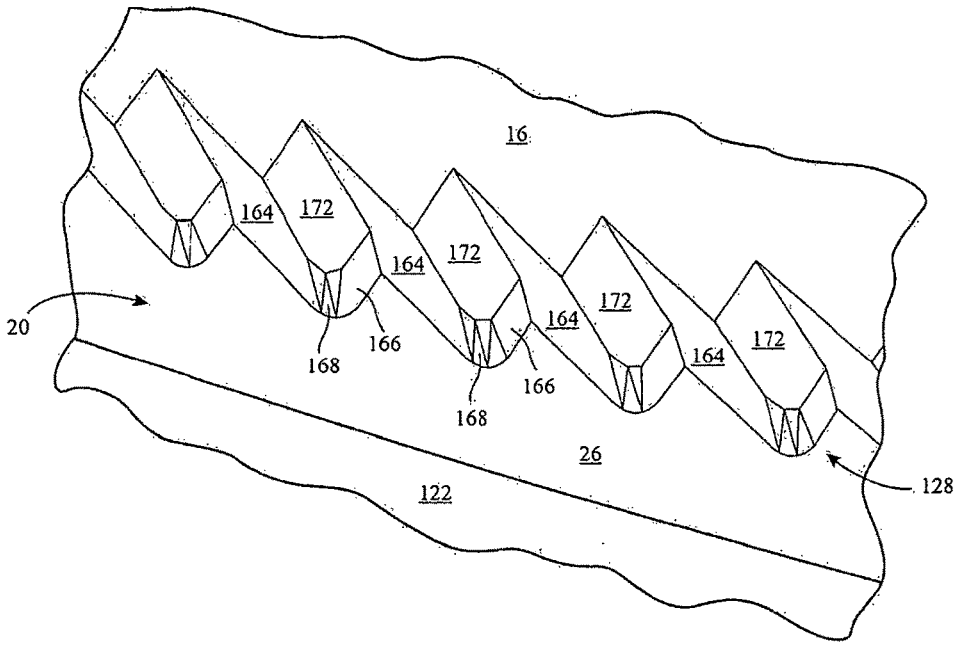
FIG. 9 is an enlarged view of an example of an irregular sidewall of a bar on a refiner plate segment.

FIG. 9 shows an embodiment of the irregular surface on the leading sidewall 128 of the bar 20. The irregular surface may be formed of repeating protrusions having a first straight sidewall 164, a second straight sidewall 166, and a curved sidewall 168 between the first straight sidewall 164 and second straight sidewall 166. A sloped ramp 172 may extend up from the substrate 122 (at the bottom of the groove 16) to the bottom edge of the second sidewall 166. The top edge of the second sidewall 166, the interior corner may be formed by the curved sidewall 168, and the first sidewall 164 are at the ridge 26 at the top of the bar 20. The first sidewall 164 and second sidewall 166 may be substantially perpendicular to each other, or may form an angle in a range of 45 degrees to 120 degrees. Alternatives to the ramp 172 include: the ramp 172 extending to the ridge 26 of the bar 20, the ramp 172 may have a lower edge above the substrate 122 at the bottom of the groove 16, or the design may not include the ramp 172.

The sloped ramp 172 extending from the substrate 122 may raise or lift fiber out of the groove 16 and move the fiber to the upper regions of the bar 20 where it is believed that much of the refining may be accomplished. The length and angle of the sloped surface 172 may be dependent on the desired extend of the irregular surface dimension, and may also be dependent on the angle and length selected for the sloped surface.

Figure 10:
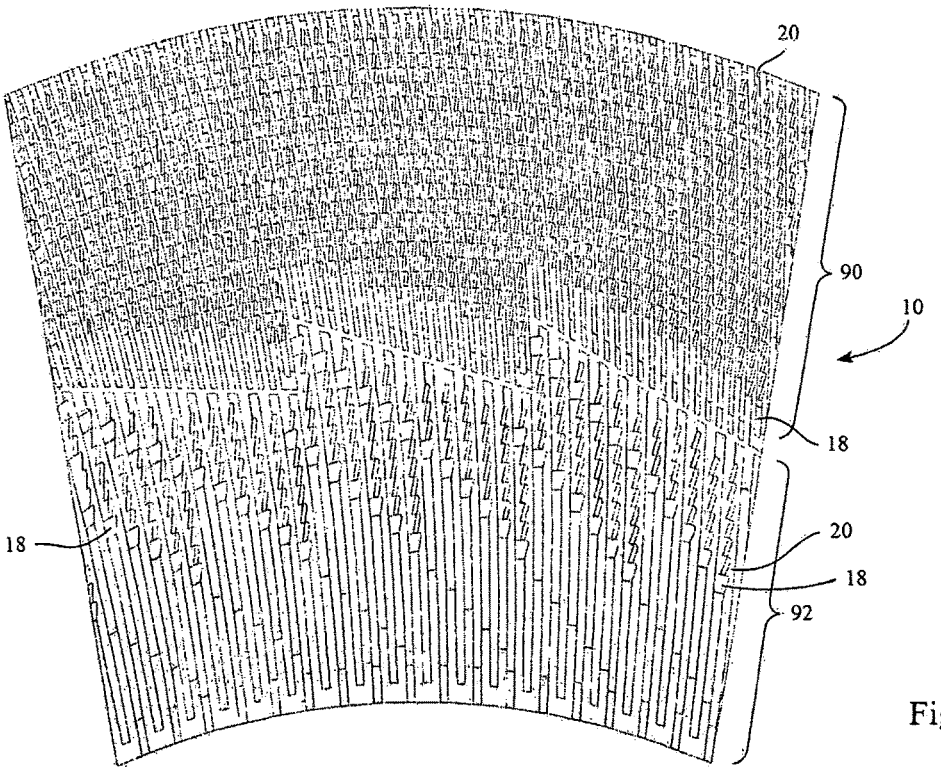
FIG. 10 is a front view of a refiner plate segment with an inner and an outer refining zone that include irregular surfaces on leading sidewalls of bars.

FIG. 10 shows a front view of an exemplary plate segment 10 having an inner refining zone 92 and an outer refining zone 90. The bars 20 in the outer refining zone 90 may be parallel to a respective radial line, or may be arranged at a small feeding or holdback angle, e.g., within 10 or 5 degrees of a radial line. The bars 20 may be curved such that at their outer radial end they form a holdback angle of 10 to 45 degrees. The inlet to the bars 20 in the outer refining zone 90 may form a Z-pattern and the radially inward portion of each of the irregular surfaces on the leading sidewall 128 may form a step pattern of groups of three bars.

The bars 20 of the inner refining zone 92 may have an inlet angle of zero, and may be straight or curved to gradually form a slight holdback angle, e.g., 5 to 15 degrees at the transition between the inner refining zones 92 and outer refining zone 90. The irregular surface on the leading sidewall 128 of the bar 20 in the inner refining zone 92 may be optional, and may be substantially coarser than the irregular surface on the radially outward portion of bar 20 in the outer refining zone 90. Alternatively, the coarseness of the irregular surface may be uniform across the entire plate. Further, the irregular surface may be finer in the outer refining zone 90 than in the inner refining zone 92. A half-height dam 18 may be positioned in the groove 16 of the inner refining zone 90, or in the groove 16 of the outer refining zone 90.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A stator refiner plate for a mechanical refiner of lignocellulosic material comprising:

a stator refining surface affixed to a substrate; multiple bars and grooves situated on the stator refining surface, wherein a bar of the multiple bars comprises a leading sidewall and a trailing sidewall opposite the leading sidewall, and wherein the bar of the multiple bars has a feeding angle; and an irregular surface on the leading sidewall; and multiple protrusions extending from the irregular surface of the leading sidewall of the bar of the multiple bars toward a trailing sidewall on an adjacent bar, wherein the irregular surface and multiple protrusions comprise at least 25% a length of the leading sidewall, wherein the bar of the multiple bars is curved with respect to a radial line extending through the stator refiner plate to define the feeding angle, and wherein the feeding angle increases continuously and gradually along a radially outward section of the stator refining surface, and wherein the feeding angle of the bar of the multiple bars disposed in the radially outward section increases at least 10 degrees in the radially outward section.

2. The stator refiner plate in claim 1, wherein the stator refiner plate has a plate segment, the plate segment including a stator refining surface.

3. The stator refiner plate in claim 1, wherein each of the multiple bars include a trailing sidewall, wherein the trailing sidewall has a smooth surface and, wherein the trailing sidewall lacks an irregular surface.

4. The stator refiner plate in claim 1, wherein the multiple bars at a radially inward section of the stator refining surface each have a feeding angle, and wherein the feeding angle of each of the multiple bars is within 20 degrees of the radial line of the stator refiner plate.

5. The stator refiner plate in claim 1, wherein the multiple protrusions extending from the irregular surface have a shape, wherein the shape is selected from the group consisting of a seven shape, a saw tooth shape, a concave shape, and a teeth shape.

6. The stator refiner plate in claim 1, wherein the irregular surface extends at or near an outer periphery of the stator refining surface, and wherein the irregular surface is not disposed at a radially inward section of the stator refining surface.

7. The stator refiner plate in claim 6, wherein a distance between the multiple protrusions on the irregular surface is in a range of 3 millimeters to 18 millimeters.

8. The stator refiner plate in claim 1 further comprising a series of ramps on the irregular surface on the leading sidewall, each ramp in the series of ramps comprises a lower edge at the substrate, wherein each ramp extends from the lower edge at least partially up the leading sidewall.

9. The stator refiner plate in claim 2 further comprising a first refining zone and a second refining zone, wherein the multiple bars disposed in the first refining zone comprises wide bars and wide grooves and the multiple bars disposed in the second refining zone comprises narrow bars and narrow grooves.

10. The stator refiner plate in claim 9, wherein the second refining zone is disposed at the radially outward section on the plate segment and wherein the first refining zone is disposed at a radially inward section on the plate segment.

11. The stator refiner plate of claim 1, wherein the stator refining surface includes an outer stator refining surface, wherein the multiple bars disposed on the outer stator refining surface have a higher density than a density of the multiple bars disposed on an inner stator refining surface.

12. The stator refiner plate of claim 1, wherein the irregular surface includes at least one protrusion of the multiple protrusions comprising:

a first sidewall, a second sidewall, and a curved sidewall between the first sidewall and the second sidewall;

a sloped ramp extending up from a bottom of an adjacent groove to a bottom edge of the second sidewall; and a top edge of the second sidewall, wherein an interior corner formed by the curved sidewall and the first sidewall are disposed at a ridge at a top of the bar of the multiple bars.

13. The stator refiner plate of claim 12, wherein the first sidewall and the second sidewall are substantially perpendicular.

14. The stator refiner plate of claim 12, wherein the first sidewall and the second sidewall form an angle in a range of 45 degrees to 120 degrees.

15. A method of mechanically refining lignocellulosic material comprising:

introducing lignocellulosic material to an inlet of opposing refiner plates, the opposing refiner plates comprising a rotor refiner plate and a stator refiner plate;

rotating the rotor refiner plate and maintaining the stator refiner plate stationary such that the lignocellulosic material moves radially outwardly through a gap between the opposing refiner plates due to centrifugal forces created by the rotor refiner plate rotation;

passing the lignocellulosic material over multiple bars disposed on a stator refining surface and through grooves between the multiple bars, wherein each of the multiple bars comprises a leading sidewall and a trailing sidewall opposite of the leading sidewall, wherein each bar of the multiple bars has a feeding angle;

inhibiting the movement of the lignocellulosic material through the grooves by interaction of the lignocellulosic material and an irregular surface on the leading sidewall of a bar of the multiple bars adjacent the groove, wherein the irregular surface comprises at least 25% of a length of the leading sidewall; and discharging the lignocellulosic material from the gap at an outer periphery of the opposing refiner plates, wherein the multiple bars are disposed on a radially outward section of the stator refining surface, wherein each bar of the multiple bars is curved with respect to a radial line extending through the stator refiner plate to define the feeding angle for each bar of the multiple bars, wherein the feeding angle increases continuously and gradually along the radially outward section, and wherein the feeding angle increases at least 10 degrees in the radially outward section.

16. The method in claim 15, wherein the passing of lignocellulosic material over the multiple bars occurs in the radially outward section of the stator refining plate.

17. The method in claim 15, wherein the irregular surface includes multiple protrusions extending from the leading sidewall toward the trailing sidewall of an adjacent bar.

18. The method in claim 15, further comprising feeding the lignocellulosic material into the gap with a series of ramps, wherein a ramp of the series of ramps comprises a lower edge at a substrate of the stator refiner plate, wherein the ramp extends from the lower edge at least partially up the leading sidewall.

* * * * *